US005407090A

United States Patent [19]

Boots

[11] Patent Number: 5,407,090

[45] Date of Patent: Apr. 18, 1995

[54] FLEXIBLE CONTAINER FOR BULK GOODS AND FLUIDS

[76] Inventor: Gerardus A. M. Boots, J.
Kruyverstraat 26, 1507 WH
Zaandam, Netherlands

[21] Appl. No.: 27,548

[22] Filed: Mar. 8, 1993

Related U.S. Application Data

[63] Continuation of Ser. No. 666,297, Mar. 8, 1991, abandoned.

[30] Foreign Application Priority Data

Mar. 9, 1990 [NL] Netherlands ..... 9000552

[51] Int. Cl.[6] ..... B65D 5/44

[52] U.S. Cl. ..... 220/470; 220/403; 220/530; 220/461; 220/666; 383/38; 383/104

[58] Field of Search ..... 206/586; 229/23 R; 220/400, 402, 403, 408, 410, 500, 501, 530, 666, 1.5, 562, 563, 564, 460, 461, 462, 463, 669, 670, 671, 675, 677, 678, DIG. 13, 565, 445; 383/104, 119, 38

[56] References Cited

U.S. PATENT DOCUMENTS

| | | | |
|---|---|---|---|
| 1,192,091 | 7/1916 | Miller | 220/9.1 |
| 2,516,100 | 7/1950 | Boardman | 220/565 |
| 3,221,872 | 12/1965 | Wood | 220/445 |
| 3,314,567 | 4/1967 | Becker et al. | 220/445 |
| 4,139,115 | 2/1979 | Robinson | 220/461 |
| 4,834,255 | 5/1989 | Boots | 229/117.05 |
| 4,901,885 | 2/1990 | Boots | 220/403 |
| 4,927,037 | 5/1990 | Boots | 220/403 |
| 5,052,579 | 10/1991 | Boots | 220/668 |
| 5,071,025 | 12/1991 | Boots | 383/104 |

FOREIGN PATENT DOCUMENTS

| | | | |
|---|---|---|---|
| 0247696 | 2/1987 | European Pat. Off. . | |
| 0276878 | 3/1988 | European Pat. Off. . | |
| 0441720 | 8/1991 | European Pat. Off. | 383/38 |
| 2290367 | 6/1976 | France | 220/562 |

*Primary Examiner*—Stephen J. Castellano

[57] ABSTRACT

A container closed at one end by a supporting surface includes a vertical tubular inner member and an outer envelope secured to the outside of the inner member. The outer envelope comprises at least four vertical partial tubular outer members equal in vertical length to and parallel to the inner member, the partial tubular outer members having an open arc-shaped cross-section with free ends at either side of the arc, each outer member being secured along both of its free ends to the outside of the inner member. The radius and location of each of the outer members relative to that of the inner member are such that, viewing the container in cross-section, four lines may be drawn, each line drawn through at least two tangent points on the outer members with at least two of the lines being parallel and intersecting tangent points on the inner member, the four lines intersecting to form a rectangle, which rectangle encloses the entire outside perimeter of the container.

6 Claims, 3 Drawing Sheets

FLEXIBLE CONTAINER FOR BULK GOODS AND FLUIDS

This application is a continuation of application Ser. No. 07/666,297, filed Mar. 8, 1991, now abandoned.

This invention relates to a container for bulk goods, fluids and the like, comprising an outer envelope, which can be closed at both ends, and an inner member, which is connected to the outer envelope at at least four points spaced about the circumference of the outer envelope and has a length that is 30–100% of the height of the container to be formed.

Such a container is known from EP-A-247696. By providing the inner member that is connected to the outer envelope, a container is obtained which is characterized by very high dimensional stability and very high stacking strength. These particular properties are obtained by causing deformative and stacking forces to be absorbed by tensile forces generated in the inner member in the circumferential direction. The container thus obtained has a substantially square bottom surface. In practice, however, a strong need is felt for containers with a bottom surface of a rectangular form deviating from a square.

It is an object of the invention to provide a container which has a bottom surface of a rectangular form deviating from a square in combination with the particular properties of the container with a square bottom surface as discussed above.

This is achieved in accordance with the invention in a container of the type described in the opening paragraph hereof, in that for obtaining a substantially block-shaped container with a bottom and cross-sections parallel thereto, substantially in the form of a rectangle deviating from a square, the starting-point is a rectangle with the desired outer dimensions and at least one inscribed circle which touches both long sides but not at least one short side of the rectangle, with a first line extending parallel to the long side and through the centre of the inscribed circle and a second line extending parallel to a short side and through the centre of the inscribed circle, which first and second line divide the rectangle into subrectangles each having an angular point coinciding with one of the angular points of the rectangle, and a bisector being drawn in the rectangle from each coinciding angular point, the centre of a further circle lying each bisector, said further circle touching the long and the short side that meet at the angular point from which the corresponding bisector has been drawn, the intersections of said further circles and said inscribed circle defining the points where the outer envelope is connected to the inner member, which intersections do not lie outside the subrectangle with the bisector in which lies the centre of the corresponding further circle, and the length of the outer circumference of the outer envelope being defined by the sum of the four lengths of the arc of the four further circles between the points where said further circles intersect said inscribed circle and the sum of the lengths of such portions of the outer circumference of the inner member as are not covered by the further circles.

By virtue of these features, starting from the substantially square container, a substantially rectangular container has been created by an imaginary bipartition of the outer envelope and by shifting one or both parts to the left or the right over a certain distance and, starting from this new "centre", constructing two angular compartments defined by the outer envelope, which compartments in turn exhibit a circular configuration such that any substantially vertical forces exerted are absorbed again by forces generated in the circumferential direction in the portions of the outer envelope referred to, which will assume the form of an arc of a circle owing to their configuration. By shifting the angular compartments outwardly in the direction of the first line, and hence enlarging them, two oppositely arranged sides of the enveloping square have thus been extended, whereby the desired enveloping rectangle has been obtained using the basic principle on which the substantially square container is based, which provides the characteristic stacking strength and very high dimensional stability, more particularly prevents lateral bulging.

As in the known substantially square container discussed hereinabove, the inner member may be constructed such that, particularly in the case of free-flowing material, the length of the outer circumference of the inner member is equal to that of the inscribed circle, or, in the case of fluids, that the length of the outer circumference of the inner member is equal to the sum of the four distances between pairs of intersections of each further circle and the inscribed circle and the sum of the four shortest lengths of the arc of the inscribed circle between the points where the inscribed circle intersects two adjacent further circles.

By virtue of the rectangular form, however, it is now also possible that the length of the outer circumference of the inner member is equal to the sum of such portion of the length of the circumference of the inscribed circle as is not covered by at least one further inscribed circle which touches both long sides and one of the short sides, plus such portion of the length of the circumference of the further inscribed circle or circles as in turn is not covered by said first inscribed circle. Here, not only the outer envelope, but the inner member as well, has been imaginarily divided into two parts. This last idea is most clearly expressed in an embodiment in which two inscribed circles are present, which intersect each other in the short axis of symmetry of the rectangle, which intersections are mutually connected by a wall member which extends along the short axis of symmetry in the fully filled condition of the container.

A further possibility, in which the original one-piece cylinder idea is maintained, but in which at the same time the rectangular form is taken into consideration at the location of the first line, is that the length of the outer circumference of the inner member is equal to the sum of such portion of the length of the circumference of the inscribed circle as is not covered by at least one inner circle which touches one of the short sides and at most one of the long sides, plus such portion of the length of the circumference of the inner circle or inner circles as, in turn, is not covered by the inscribed circle.

The angular compartments can be shaped in many ways. Thus, each further circle may have a different diameter. However, it is preferable that the further circles in pairs have the same diameter relative to the first line or that all further circles have the same diameter.

The intersections of a further circle and the inner member do not lie outside the subrectangle within which the corresponding further circle is constructed. In the most extreme case, this means that of two adjacent further circles, whose centres are disposed on opposite sides of the first line and which have the same diameter, one of the intersections of the further circle and the inscribed circle lies in the first line. The other intersection will invariably be located within the subrectangle.

The location of the inscribed circle within the rectangle may vary from a position where it touches one short side of the rectangle to a position where it touches the other short side of the rectangle, depending on the desired outer form of the container in filled condition, the ratio between short and long sides of the rectangle and the like. When maximum symmetry in the container is aimed for, the inscribed circle should not touch either short side of the rectangle, in such a way that the centre of the inscribed circle is located at the intersection of the diagonals of the rectangle, a further requirement being that the diameters of the further circles are all equal.

In accordance with a further elaboration of the principle of the invention, there may be provisions such that between two adjacent further circles, whose centres are located on opposite sides of the first line, the outer envelope is defined by an additional circular arc which is part of an additional circle which touches the adjacent short side of the rectangle and touches or intersects the two adjacent further circles referred to. A container of maximum symmetry, i.e. a container that is mirror-symmetric relative to the first line, is then obtained when the two adjacent further circles referred to have the same diameter and the centre of the additional circle is located in the first line. Using the basic principle of the invention, by means of one or two of such additional circular arcs the rectangular form can be approximated even further; naturally with the very high dimensional stability and high stacking strength being maintained. Depending on the material that is used and the cost of manufacture, it must be determined in each case whether or not it is useful in practice to employ such additional circular arcs.

The closest possible approximation of the rectangular form can also be obtained in accordance with a further embodiment of the invention when two inscribed circles are present, which intersect each other in the short axis of symmetry of the rectangle, which intersections are mutually connected by a wall member which extends along the short axis of symmetry when the container is in fully filled condition.

When outer envelope and inner member both have an uninterrupted continuous circumference, this will result in a configuration in which the outer envelope and the inner member are in surface-to-surface engagement along the portions of the inner member's outer circumference that are not covered by bulging circular arcs. Further, in this embodiment it is very well possible for the inner member to consist of a net.

When both outer envelope and inner member are made of a material that is impervious to the material to be packaged, it may be preferable, for reasons of economy regarding packaging material, that the outer envelope or the inner member is omitted along the portions of the inner member's outer circumference that are not covered by bulging circular arcs.

Such a container can be realized in a relatively simple manner when it is made from four parts, all consisting of a sheet of material of a transverse dimension equal to the height of the container to be formed, with, respectively, a first, second, third, fourth part having a length equal to that of the outer envelope and inner member in, respectively, a first, second, third, fourth subrectangle, with a portion of each sheet of material being folded back, the portion that is not folded back having a length equal to that of the inner member in the corresponding subrectangle, the portion that is folded back being secured to the portion that is not folded back at the desired intersections of the inscribed circle and the further circle and the length of the sheet of material that is folded back, between the two points of attachment being equal to the length of the arc of the corresponding further circle between the intersections referred to, which four members are mutually connected by securing to each other pairs of folding-back lines and pairs of ends that have not been folded back, throughout the entire height of the container.

Manufacture from two parts is also possible. Then these parts should consist of a sheet of material with a transverse dimension equal to the height of the container to be formed, with one part having a length equal to that of the outer envelope and the inner member in two adjacent subrectangles and the other part having a length equal to that of the outer envelope and the inner member in the two remaining subrectangles, with a portion of each sheet of material being folded back at both ends thereof, the portion that has not been folded back having a length equal to that of the inner member in the corresponding subrectangles, the portions that have been folded back being secured to the portion that has not been folded back at the desired intersections of the inscribed circle and the further circles and the length of each portion of the sheet of material that has been folded back, between two points of attachment in a subrectangle being equal to the length of the arc of the corresponding further circle in said subrectangle between said intersections, which two portions are mutually connected by securing to each other pairs of folding-back lines throughout the entire height of the container.

Although the foregoing constructions mainly relate to containers with a single, cylindrical inner member and four bulging circular arcs, one end of each of which is located in the first line, the other configurations of the container according to the invention can be realized with comparatively simple adjustment of the stitching patterns and lengths of sheets of material to be used.

The container according to the invention will now be further discussed and explained with reference to the embodiments shown in the accompanying drawings, in which.

Figure 1:
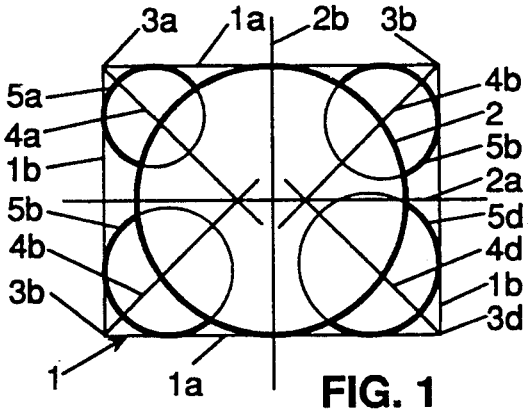
FIGS. 1–14 are each diagrammatic horizontal cross-sections of a container according to the invention.

In FIG. 1 the desired rectangular circumference of a container is designated by rectangle 1 with two long sides 1*a* and two short sides 1*b*. Provided in the rectangle 1 is an inscribed circle 2, which has a diameter equal to a short side 1*b* and touches both long sides 1*a*. From each angular point 3*a*–3*d* of the rectangle 1 a bisector 4*a*–4*d* has been drawn, with pairs of bisectors starting from the same short side 1*b* (4*a*, 4*b*, and 4*c*, 4*d*, respectively) intersecting each other in the axis 2*a* of the inscribed circle 2, extending parallel to the long sides 1*a*.

The distance between the intersection of one pair (4*a*, 4*b*) and that of the other pair (4*c*, 4*d*) of bisectors on the axis 2*a* is always equal to the difference in length between the long side 1*a* and the short side 1*b*, while the axis 2*b* of the inscribed circle 2, extending parallel to the short sides 1*b*, will intersect the axis 2*a* at right angles between the intersections or, in an extreme case, in an intersection. Intersection of axes in an intersection is a borderline case, in which the inscribed circle 2 touches one of the short sides 1*b*. The axes 2*a* and 2*b* divide the rectangle 1 into four subrectangles, each containing one of the angular points 3*a*–3*d* of the rectangle 1 and one bisector 4*a*–4*d* starting therefrom.

Located in each of the bisectors 4*a*–4*d* is the centre of a further circle 5*a*–5*d*, each further circle 5*a*–5*d* touching the long side 1*a* and the short side 1*b* which meet in the angular point 3*a*–3*d* from which the corresponding bisector 4*a*–4*d* starts. The diameters of the further circles 5*a*–5*d* are in fact mutually independent and can be selected within a wide margin, although the intersections of the further circles 5*a*–5*d* and the inscribed circle 2 must lie within the subrectangle which contains the bisector in which the centre of the corresponding further circle 5*a*–5*d* is disposed, or one intersection must lie within the subrectangle and the other in the axis 2*a*.

In the foregoing the constructive configuration of the container has been described. The container itself comprises an inner member which in fully filled condition assumes the form of a cylindrical part with a cross-section equal to that of the inscribed circle 2, and an outer envelope which in fully filled condition assumes the form of four bulges in the form of a circular arc corresponding to such portions of the four further circles 5*a*–5*d* as are situated outside the inscribed circle 2, while between said circular arcs the outer circumference of the inner member is followed. Viewed in cross-section and fully filled condition, the container comprises the portions indicated in FIG. 1 by thick lines.

Figure 2:
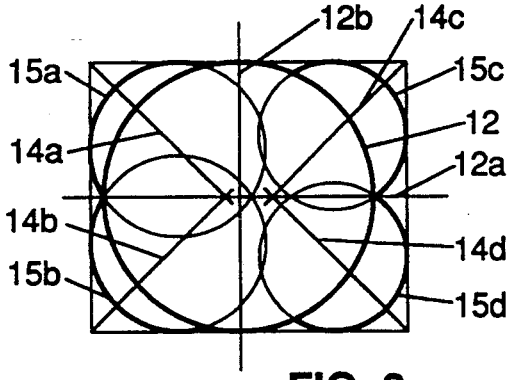

In FIG. 1 the axis 2*b* extends symmetrically relative to the short sides 1*b*, i.e. precisely intermediate the two intersections of the bisectors 4*a*–4*d* and the axis 2*a*. As previously stated, that intersection may be located at any point between the two intersections referred to. A shift from the middle is illustrated in FIG. 2, where axis 12*b* intersects axis 12*a* at a point closer to the intersection of bisectors 4*a* and 14*b* than to the intersection of bisectors 14*c* and 14*d*. FIG. 2 differs further from FIG. 1 in location and form of the further circles 15*a*–15*d*. The further circles 15*a* and 15*b* have the same diameter, while their centres are located in the bisectors 14*a* and 14*b*, such that both intersect the inscribed circle 12 in the axis 12*a*, and accordingly do so at the same point. Circles 15*c* and 15*d* have a similar location, although their mutually equal diameter is smaller than that of the circles 15*a* and 15*b*. As in FIG. 1 and all other Figures to follow, the actual wall portions of the container are indicated by thick lines.

Figure 3:
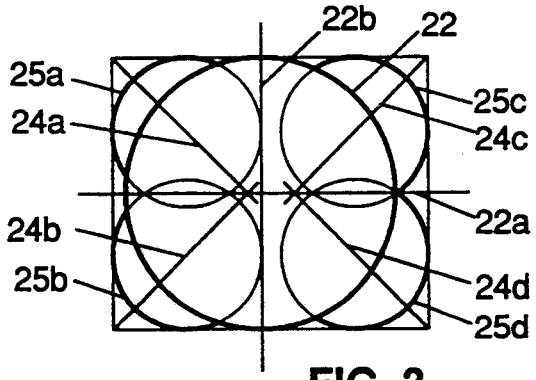

Four equal further circles 25*a*–25*d* are shown in FIG. 3. Because the location of the axis 22*b* relative to the intersections of the bisectors 24*a*–24*d* and the axis 22*a* is the same as that in FIG. 2, the further circles 25*a* and 25*b* will intersect the inscribed circle 22 at a distance from the axis 22*a* and hence within their corresponding subrectangles.

Figure 4:
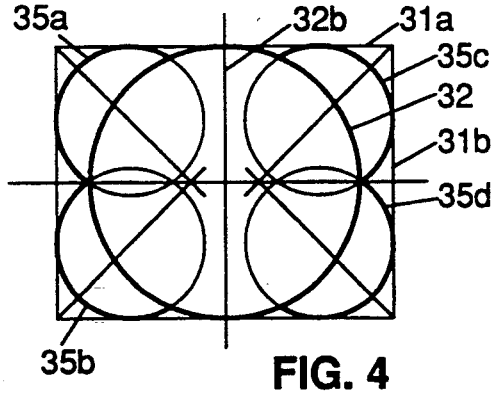

FIG. 4 in turn shows a situation where four equal further circles 35*a*–35*d* are used and the axis 32*b*, as in FIG. 1, is arranged symmetrically relative to the two short sides 31*b*. Thus, a rectangular container of maximum symmetry can be obtained.

Figure 5:
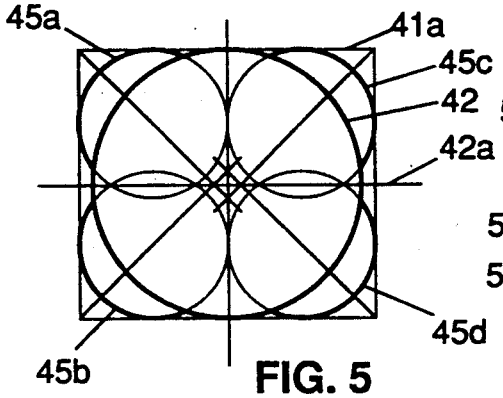

A variant of the symmetrical container according to FIG. 4 is shown in FIG. 5. The dimensions of the further circles 45–45*d* are equal to those according to FIG. 4, but the length of the long side 41*a* has been selected to be smaller than that of the long side 31*a* in FIG. 4. As explained hereinbefore, as a result the intersections of the further circles 45*a*–45*d* and the inscribed circle 42 will not coincide in the axis 42*a* anymore.

Figure 6:
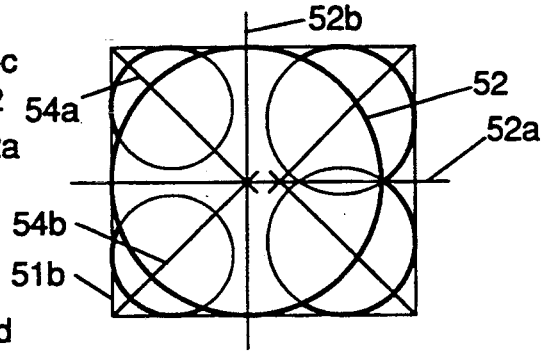

FIG. 6 shows a situation where the intersection of the axis 52*b* and the axis 52*a* coincides with the intersection of the bisectors 54*a* and 54*b*. As a result, the inscribed circle 52 will touch the short side 51*b*.

Figure 7:
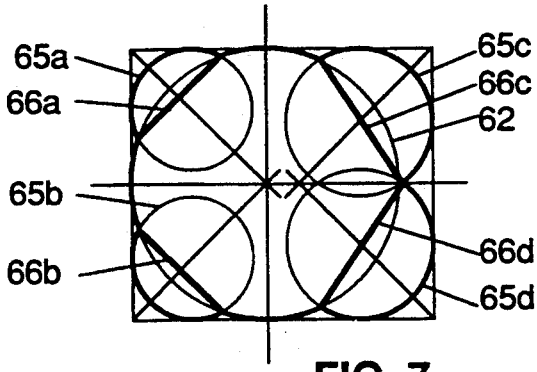

FIG. 7 shows an embodiment comparable to FIG. 6 in terms of construction, but this embodiment is intended in particular for packaging fluids. Owing to the fact that in a fluid the pressure is transmitted uniformly and instantly, the form of the inner member may deviate from a cylinder, i.e. where a wall portion of the container is in contact with the packaged fluid on both sides, at least if the fluid on one side communicates with the liquid on the other side of the wall portion. As shown in FIG. 7, they are such portions of the inner member as are covered by bulging circular arcs of the outer envelope. It is important that the points of the container that define the multiple circular arc configuration of the outer circumference are retained in the proper position, i.e. the intersections of the inscribed circle 62 and the further circles 65–65*d*. To that effect, the two intersections of each further circle 65*a*–65*d* and the inscribed circle 62 are mutually connected by planar, straight wall portion 66*a*–66*d*, which wall portions are mutually connected by circular arc portions having a radius equal to that of the inscribed circle 62.

Figure 8:
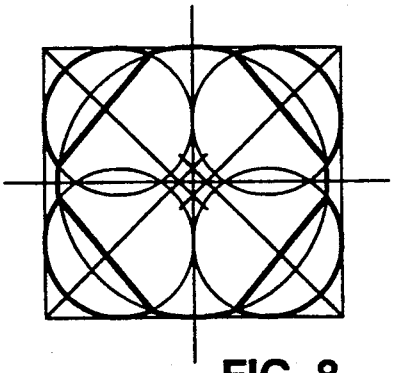

FIG. 8 shows an embodiment comparable to that according to FIG. 5, but FIG. 8 shows a configuration again which is intended in particular for packaging fluids. It is observed that in the case of certain free-flowing materials, similar conditions as in the case of fluids can be created, particularly when the inner member is made of a net, which readily allows the packaged material to move from one compartment to another within the outer envelope of the container.

Figure 9:
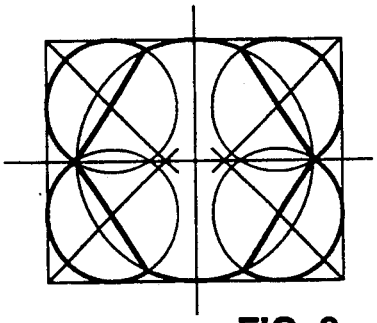

A third embodiment for packaging fluids in particular is shown in FIG. 9, which embodiment is comparable to that according to FIG. 4.

It will be clear that a container according to the invention cannot contain any exact square angles. It will also be clear, however, that a square angle is approximated more closely according as the radius of a further circle is smaller. However, according as the radius of the further circles decreases, the space between two further circles on a short side of the rectangle increases. In cases where the further circles are chosen to be comparatively small and the free intermediate space is to be used as much as possible, the embodiment according to FIG. 10 can be opted for. In this embodiment, the outer envelope is extended to include two additional circular arcs, each following an additional circle 77*a* or 77*b*, which touches the short side 71*b* and intersects the inscribed circle 72 at the same points as the further circles 75*a*–75*b* or 75*c*–75*d*. In the embodiment shown, the centres of the additional circles 77*a* and 77*b* are located in the axis 72*a* and the diameters are equal. This is the consequence of the use of four identical further circles 75*a*–75*d*. When the circles mentioned last are mutually different, the diameters of the additional circles may also be mutually different and/or their centres may not be located in the axis 72*a* anymore.

Figure 11:
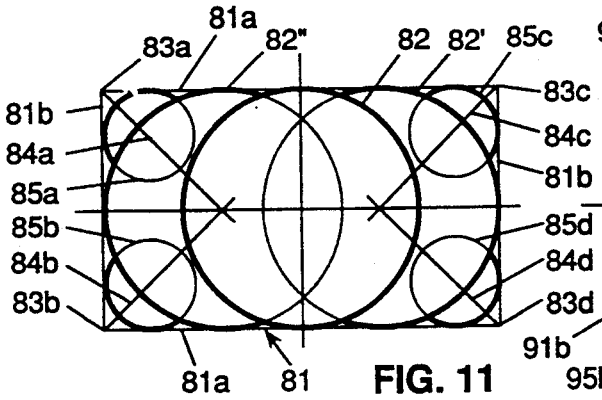

When a container is contemplated which is considerably longer than it is wide, for instance when the long side of the rectangle is to be twice as long as the short side of the rectangle, the embodiment shown in FIG. 11 can be opted for. This embodiment comprises what may be called an extended inner member. The starting point is rectangle 81 with three inscribed circles 82, 82' and 82'', all touching both long sides 81*a* of the rectangle, while the inscribed circle 82 is arranged symmetrically relative to the two short sides 81*b* of the rectangle, the inscribed circle 82' touches one short side 81*b* of the rectangle and the inscribed circle 82'' touches the other short side 81*b* of the rectangle. In accordance with the teachings of the invention, from the angular points 83*a*–83*d* of the rectangle 81, bisectors 84*a*–84*b* have been drawn, in which the centres are located of further circles 85*a*–85*d*, which touch the adjacent short side and long side of the rectangle 81. It is observed that in this embodiment the inscribed circle 82' and/or 82'' need not touch the short side 81*b* of the rectangle, but may be spaced from it, as shown in a number of the foregoing embodiments, while one or more additional inscribed circles can be used for an even longer container.

Figure 12:
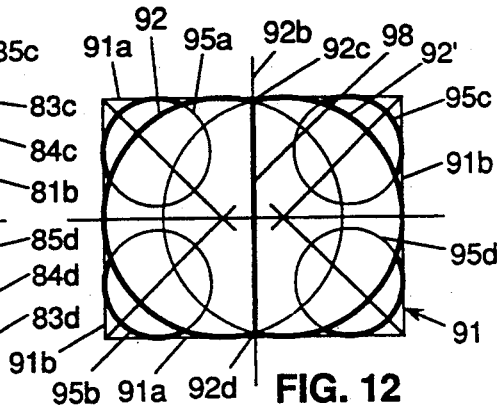

FIG. 12 shows an embodiment in which the inner member is formed by circular arcs of two inscribed circles 92 and 92'' each touching both long sides 91*a* of the rectangle and each touching one of the short sides 91*b* of the rectangle. It is observed that, as in the previous embodiment, the inscribed circle 92 and/or 92' need not touch the adjacent short side of the rectangle. To enable the inner member of the container to function in the proper desired manner, the intersections of the two inscribed circles 92 and 92' must be retained in their positions. This is provided for by a central planar wall member 98, which extends according to the axis 92*b* and connects the two intersections 92*c* and 92*d* of the inscribed circles 92 and 92' and which may or may not be provided with passages. Naturally, in accordance with the invention, further circles 95*a*–95*d* are present again in the corner areas of the rectangle 91.

Figure 13:
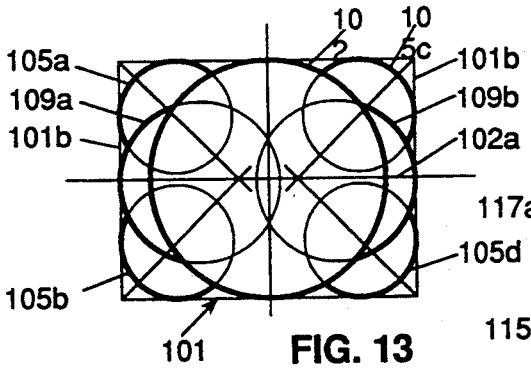

FIG. 13 illustrates a further possibility of extending the inner member. To that effect, in addition to the inscribed circle 102, another two inner circles 109*a* and 109*b* have been provided within the rectangle 101, which circles each touch a short a short side 101*b* of the rectangle and have a diameter which is smaller than that of the inscribed circle 102. The diameters of the inner circles 109*a* and 109*b* need not be mutually equal, nor is it requisite for the centres thereof to be in the axis 102*a*, as shown in FIG. 13. Further, in accordance with the invention, again four further circles 105*a*–105*d* are provided within the rectangle 101. Comparison of FIG. 13 and, for instance, FIG. 1, shows that through the use of the inner circles 109*a* and 109*b* the outer envelope of the container approximates the desired rectangular form more closely, but also that the manufacture of the container is rendered more complicated and the required amount of material increases. In individual cases, therefore, it will mostly depend on a consideration of costs what container is chosen.

Figure 10:
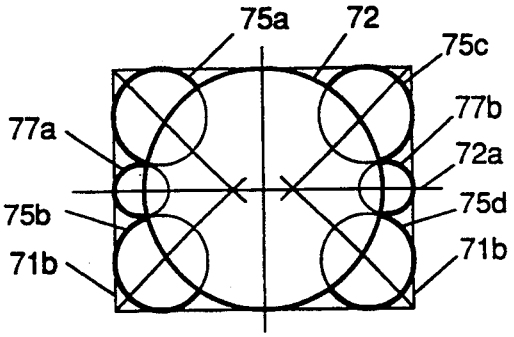
Figure 14:
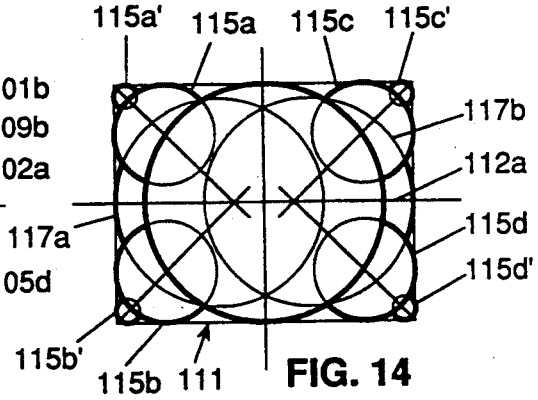

A variant which can be seen as a combination of the embodiments according to FIGS. 10 and 13 is shown in FIG. 14. In this embodiment, the space between two further circles 115*a* and 115*b* or 115*c* and 115*d* on opposite sides of the axis 112*a* is filled up in the manner of FIG. 10 with a circular arc of an additional circle 117*a* or 117*b*. However, these additional circles are constructed in the manner of the inner circles as used in the embodiment according to FIG. 13, but in this embodiment at an intersection of an additional circle 117*a* or 117*b* and a further circle 115*a*, 115*b* or 115*c*, 115*d*, the wall portion of the container which follows the circular arc of the corresponding further circle continues up to the inner member, instead of up to the wall portion which follows the circular arc of the inner circle, as is the case in the embodiment according to FIG. 13.

An even closer approximation of the rectangle 111 can be realized when, in further elaboration of the principle of the invention, a second group of four further circles 115*a'*–115*d'* is constructed, which, like the first four, touch a short side and a long side of the rectangle and have a centre which is located in a bisector starting from the angular point of the rectangle 111 where the long and the short side of the rectangle meet. The diameters of the second four further circles 115*a'*–115*d'* will be comparatively small, as will appear from FIG. 14. Still, the second four further circles 115*a'*–115*d'* cannot just be considered of theoretical significance. A filling thereof, for instance when a fluid is to be packaged, can be accomplished in a comparatively simple manner. Further, the second four further circles 115*a'*–115*d'* can provide spaces for arranging, for instance, rods or bars of a stacking frame or an auxiliary frame for keeping the container open during filling.

Figure 15:
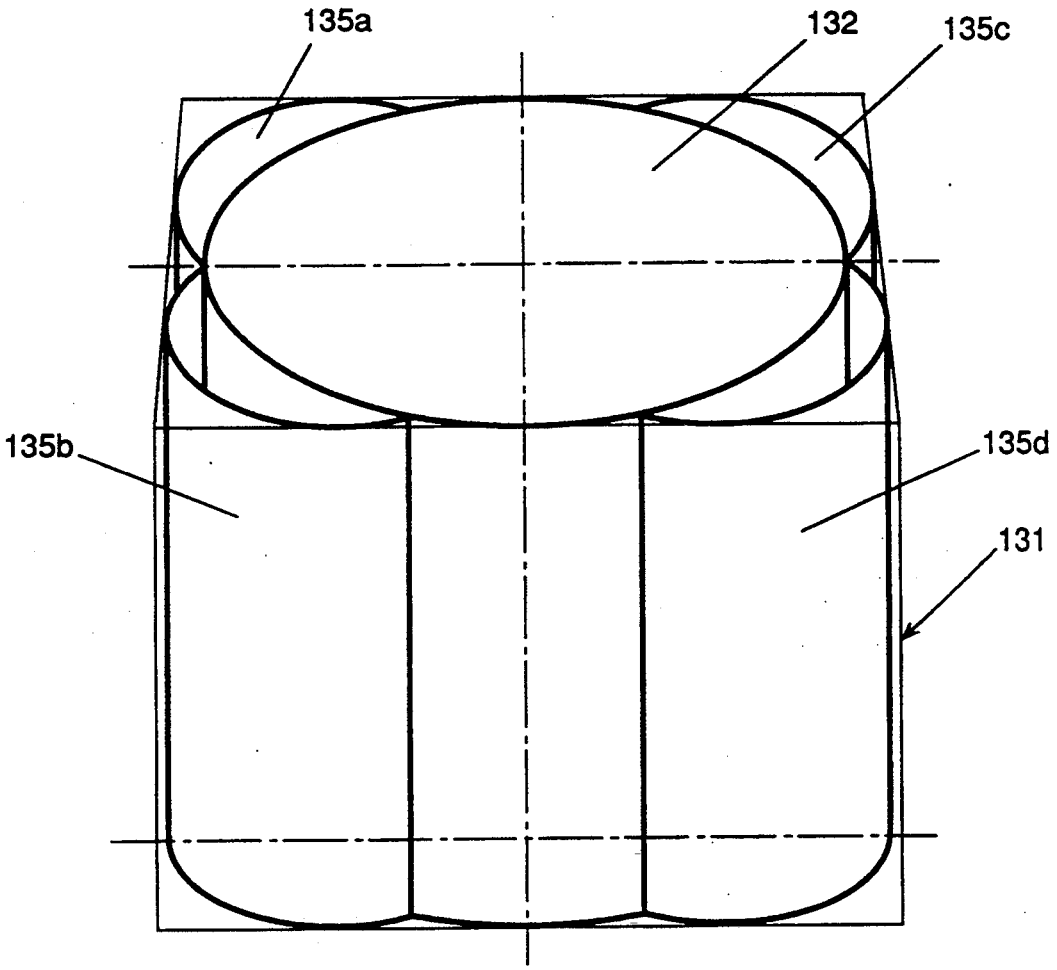
FIG. 15 is a perspective view of the container according to FIG. 4 in apparently filled condition.

FIG. 15 is a perspective view of the container according to the embodiment of FIG. 4 in the position the container will assume when in fully filled condition. The container consists of an inner member 132 in the form of a cylinder of circular cross-section in accordance with the inscribed circle 32 in FIG. 4. Mounted on this inner member 132 are four bulging wall portions 135*a*–135*d* of circular arc configuration, which have been arranged in accordance with the teachings of the invention, i.e. as explained further with reference to the further circles 35*a*–35*d* of FIG. 4. The wall portions 135*a*–135*d* accordingly touch the lateral faces of a right block 131 of rectangular, horizontal cross-section. As previously stated, a container according to the invention is characterized by, among other things, non-bulging sidewalls in fully filled condition. This means that, if so desired, without problems the fully filled container can be moved into an encasing box, bag or crate, which box, bag or crate has inner dimensions which correspond at least to those of the right block 131. Naturally, the container may also be arranged in such a box, bag or crate prior to filling.

For closing the container at the top and bottom by means other than an encasing box, bag or crate, pieces of packaging material attached to the outer envelope may be provided. In addition, it is also possible to make the outer envelope longer than the inner member and to arrange for the outer envelope to extend beyond the inner member at the top and/or bottom, which portions are adapted to fold inwards and will form the cover and/or the bottom of the container, with optional securing.

Figure 16:
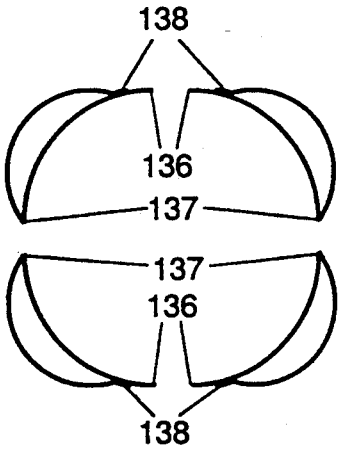
FIG. 16 is a top plan view of four prepared sheets of material, which form the container according to FIG. 4 after mutual connection.
Figure 17:
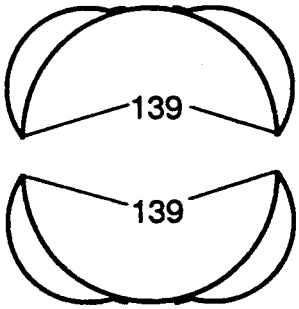
FIG. 17 is a top plan view of two prepared sheets of material, which form the container according to FIG. 4 after mutual connection.

FIGS. 16 and 17 illustrate two ways of realizing a container according to FIG. 15. In FIG. 16, the starting point is four sheets of material, each in principle having a length corresponding to a quarter of the circumference of the inner member 132 plus the length of the circular arc of one of the wall portions 135*a*–135*d*. Starting from a free end 136, the sheet of material is folded back after a length of a quarter of the circumference of the inner member 132, whereby a folding line 137 is formed. The portion that has been folded back is secured to the other portion of the sheet of material along a line 138 located at a point to be determined using an auxiliary construction figure, for example FIG. 4 in the present case. The point referred to is the intersection of a further circle 35*a*–35*d* and the inscribed circle 32 near the long side 31*a* of the rectangle. The sheets of material treated thus must be brought in the position relative to each other as shown in FIG. 16, after which the container can be obtained by means of mutually securing two pairs of folding lines 137 and two pairs of free ends 136.

FIG. 17 starts from two sheets of material, with the two free ends of each sheet being folded back to form a folding line 139 and with the free ends being secured at a point corresponding with 138 in FIG. 16. The container can now be completed by interconnecting pairs of folding lines 139.

It will be clear that many further variants and modifications are possible within the framework of the invention. Thus, the invention is not limited to the embodiments shown in FIGS. 1–14 and many combinations and mixtures other than those shown and discussed are likewise possible. Similarly, the realization forms for obtaining a container according to the invention as shown in FIGS. 16 and 17 are given only by way of example and are not intended to limit the invention in any way.

I claim:

1. A container of flexible material closed at one end, the container comprising a vertically tubular, inner member and an outer structure secured to the outside of the inner member, a supporting surface having a substantially rectangular contour having two equal short sides and two equal long sides which are longer than said short sides, said supporting surface closing said container of flexible material, said vertically tubular, inner member comprising a tubular section having a circular cross-section, said cross-section having a diameter equal in length with one of said short sides of said supporting surface and being tangent to both said long sides of said supporting surface, the outer structure comprising at least four vertical, partially tubular, outer members equal in vertical length to and parallel to the inner member, said partially tubular, outer members each having an open portion having a cross-sectional shape of an arc of constant radius, said open portion having free ends at both ends of the arc of said open portion, each outer member being secured along both of its free ends to said inner member, each outer member having a tangent point on one of said equal short sides of said supporting surface as well as on one of said equal long sides of said supporting surface.

2. A container according to claim 1, wherein said container of flexible material is made from four parts, each part comprising a sheet having a transverse dimension equal to the height of the container of flexible material to be formed, with each of the four parts having a length equal to that of the arc of one of the four outer tubular members plus one fourth the arc of said inner member, with each sheet being folded back.

3. A container according to claim 1, wherein the container of flexible material is made from two parts, both parts consisting of a sheet having a transverse dimension equal to the height of the container of flexible material to be formed, with each part having a length equal to that of the arcs of two consecutive outer members of said outer members plus half the arc of said inner member, with each sheet being folded back at both ends of its length.

4. The container of claim 1, wherein the inner member further comprising at least one vertical, partially tubular, extension member equal in vertical length to and parallel to said tubular section of said inner member, each extension member having an open arc-shaped cross-section with free ends at either side of the arc, each extension member being secured along both of its free ends to the outside of the tubular section.

5. The container of claim 4, wherein a radius of said open arc-shaped cross-section of each extension member is equal to the radius of the tubular section.

6. A container of flexible material closed at one end, the container comprising a vertically tubular, inner member and an outer structure secured to the outside of the inner member, a supporting face having a substantially rectangular contour having two equal short sides and two equal long sides which are longer than said short sides, said supporting face closing said container of flexible material, said vertically tubular, inner member comprising a tubular section with a cross-section composed of four open portions having a cross-sectional shape of an arc of constant radius and of four planar wall portions having a cross-sectional shape of a straight line, said open portions and said wall portions being connected to each other in alternating sequence to form a closed circumference, two of said open portions separated by one of said wall portions and one of said open portions being tangent to one of said long sides of said supporting face, the outer structure comprising at least four vertical, partially tubular, outer members equal in vertical length to and parallel to the inner member, said partially tubular, outer members each having an open portion having a cross-sectional shape of an arc of constant radius, each said open portion of said outer member having free ends at both ends of the arc of said open portion of said outer member, each outer member being secured along both of its free ends to said inner member outwardly adjacent said planar wall portion of said inner member, each outer member having a tangent point on one of said equal short sides of said supporting face as well as on one of said equal long sides of said supporting face.

* * * * *